US005474015A

United States Patent [19]

Bruce

[11] Patent Number: 5,474,015

[45] Date of Patent: Dec. 12, 1995

[54] DRAG EMBEDMENT MARINE ANCHOR

[75] Inventor: Peter Bruce, Onchan, Great Britain

[73] Assignee: Brupat Limited, Isle of Man, United Kingdom

[21] Appl. No.: 244,540

[22] PCT Filed: Nov. 27, 1992

[86] PCT No.: PCT/GB92/02210

§ 371 Date: Aug. 19, 1994

§ 102(e) Date: Aug. 19, 1994

[87] PCT Pub. No.: WO93/11028

PCT Pub. Date: Jun. 10, 1993

[30] Foreign Application Priority Data

Nov. 27, 1991 [GB] United Kingdom ..... 9125241

[51] Int. Cl.[6] ..... B63B 21/20

[52] U.S. Cl. ..... 114/294; 114/301; 114/304

[58] Field of Search ..... 114/294, 301, 114/304, 310, 299

[56] References Cited

U.S. PATENT DOCUMENTS 3,407,775 10/1968 Lunde .
3,685,479 8/1972 Bruce .
4,369,727 1/1983 Fasco .

FOREIGN PATENT DOCUMENTS 168099 11/1903 Germany .
0711754 7/1966 Italy ..... 114/294
1296139 11/1972 United Kingdom .
2171970 9/1986 United Kingdom .

OTHER PUBLICATIONS

"Marine Engineering and Shipbuilding Abstracts," vol. 2, No. 2 (1972).

*Primary Examiner*—Sherman Basinger
*Attorney, Agent, or Firm*—Popham, Haik, Schnobrich & Kaufman, Ltd.

[57] ABSTRACT

A marine anchor comprising a fluke and a shank attached to the fluke is intended for drag embedment in a mooring bed by pulling the anchor substantially horizontally via the shank. Further, it is a particular feature of the anchor that two modes of operation are possible through use of the line extending between the anchor cable attachment point on the shank and the fluke centroid being variable to provide a first line present for drag embedment of the anchor, and a second line utilized when the anchor is embedded, wherein the pulling force on the anchor via the shank can now be essentially upwards, thereby providing an increased holding force due to the increased fluke area presented in the direction of the upwards force. The change in direction from the first line to the second line can be achieved by having the shank pivotal and by providing pivot control members permitting selective pivoting of the shank. Alternatively, two separate cable attachment point can be present in the shank with, as a first example, two separate cables attached to the cable attachment points, whereby the two modes of anchor operation are achieved by transferring operation from a first cable to the second, or as a second example moving the single anchor cable via a guide from the first attachment point to the second.

46 Claims, 8 Drawing Sheets

FIG. 1
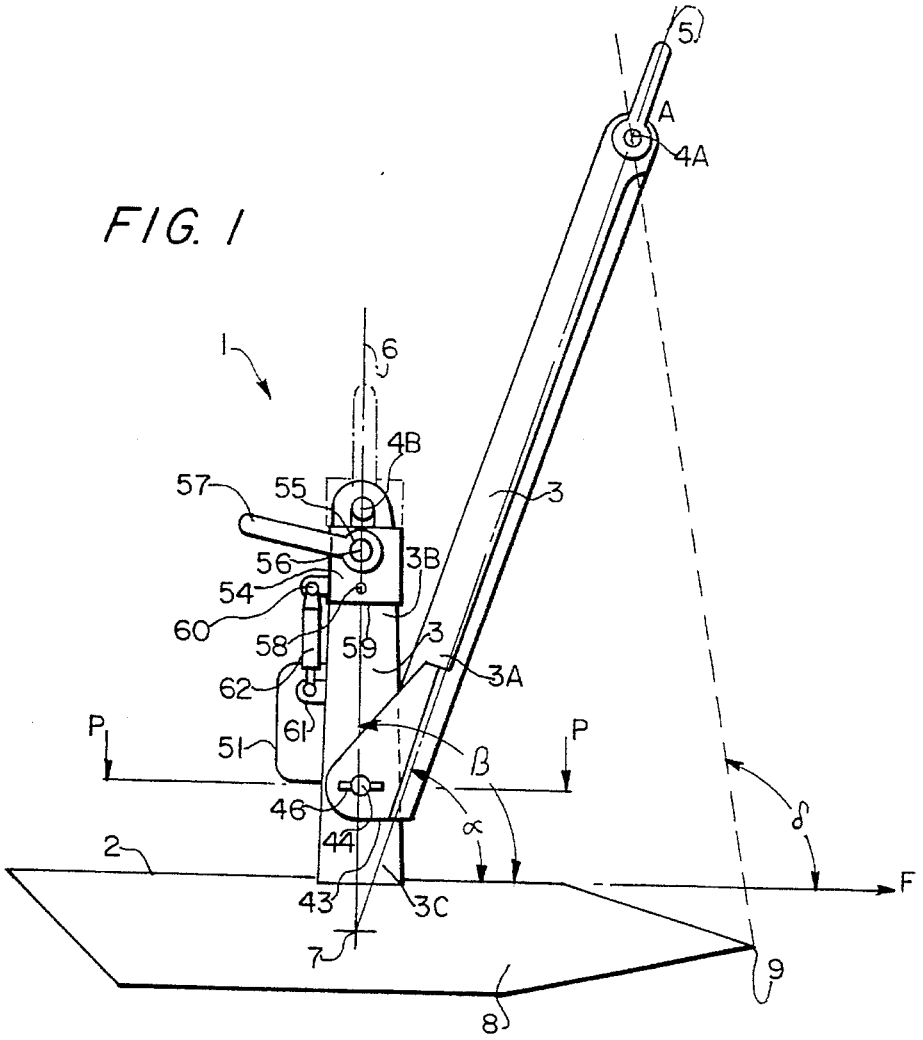
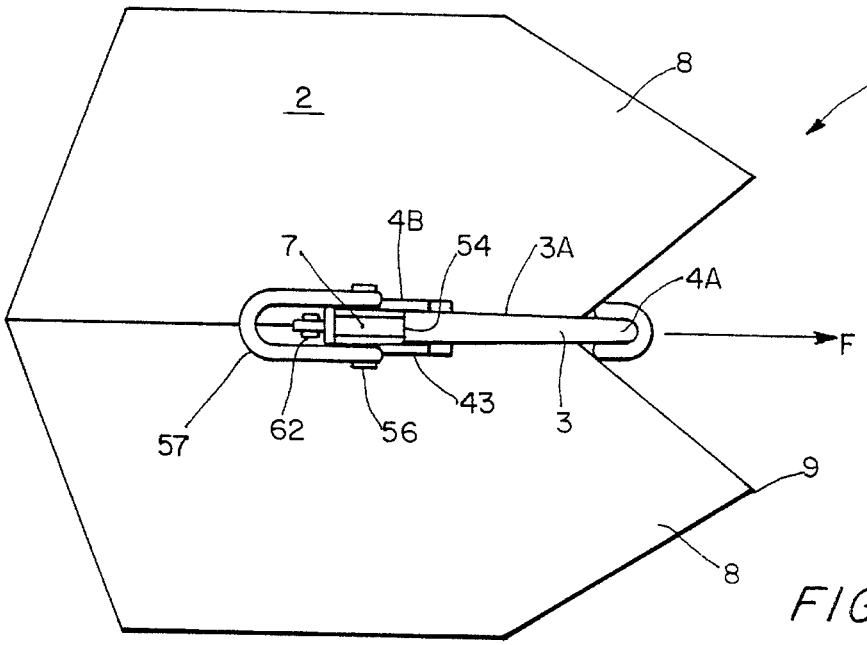
FIG. 2

DRAG EMBEDMENT MARINE ANCHOR

FIELD OF THE INVENTION

The present invention relates to drag embedment marine anchors.

DESCRIPTION OF THE PRIOR ART

A requirement of a drag embedment marine anchor comprising a fluke attached to a shank is an ability to dig deeply into a mooring bed. The holding capacity is directly related to depth of embedment below the surface of the mooring bed. The ability to dig into the mooring bed soil depends on the anchor having a fluke angle appropriate for the particular soil present in the mooring bed. The fluke angle is usually defined as the angle between the forward direction of the fluke and a line connecting the anchor cable attachment point on the shank to a point on the rear edge of the fluke measured in a fore-and-aft plane of symmetry of the anchor. In practice, this angle is about 50° for muds and about 30° for sands. The angle that a straight line containing the cable attachment point and the centroid of the fluke forms with the forward direction of the fluke is correspondingly in the range 60° to 70° for muds and 35=20 to 45° for sands where the fluke is of triangular or rectangular shapes with a length to breadth ratio in the usual range between 1 and 2. This latter angle may be regarded as the centroid fluke angle.

The angle of friction, $\phi$, between a marine soil and a smooth steel anchor fluke is usually in the range 22° to 30° for sand and 6° to 14° for mud. Thus, the centroid fluke angle is always made less than $(90-\phi)$ degrees to ensure that a pulling force applied at the anchor cable attachment point causes the anchor to penetrate by sliding in the soil in the forward direction of the fluke and so bury increasingly below the surface of the mooring bed when pulled horizontally thereon.

A deeply buried marine drag embedment anchor is usually recovered by heaving vertically upwards on the anchor cable attached to the forward end of the anchor shank or by heaving vertically upwards on a pendant cable attached to the anchor at the rear edge of the fluke. This vertical pull first rotates the anchor in the soil until the centroid of the fluke lies vertically below either the cable attachment point on the shank (referred to as the break-out position) or the pendant cable attachment point at the rear edge of the fluke. When heaved up by the anchor cable, following rotation, the anchor simply continues "digging" in the forward direction of the fluke but obliquely to the vertical instead of obliquely to the horizontal until it emerges from the surface of the mooring bed. When heaved up by the pendant cable, following rotation, the anchor moves vertically upwards in the soil since the vertical cable lies in the rotated direction of the fluke.

The breaking-out force is least when heaving up by the pendant cable and greatest when heaving up by the anchor cable. Peak breaking-out force occurs in the anchor cable immediately following rotation of the anchor and just before movement oblique to the vertical occurs. This peak breaking-out force in the anchor cable usually has a magnitude of approximately 20 to 30 per cent of prior peak horizontal embedment force in sands and of the order of 100 per cent in muds. Generally, minimisation of anchor breaking-out force is, inter alia, an objective of drag embedment anchor design.

In contrast, it is an object of the present invention to provide a drag embedment marine anchor and a method wherein the breaking-out force at the break-out position is maximised. It is another object of the present invention to provide a drag embedment marine anchor and a method wherein the holding capacity may be increased at a given depth of embedment in a mooring bed soil.

Yet another objective of the present invention is to provide a method of limiting the load developed by a marine anchor during drag embedment to permit dragging to a desired location at constant load prior to increasing the holding capacity at such desired location.

These objectives are met, in accordance with the present invention, by providing an anchor which embeds in a mooring bed soil when pulled at an anchor cable attachment point at a relatively small fluke centroid angle and which can be subsequently pulled at an anchor cable attachment point at a larger fluke centroid angle whereby movement of the anchor in the direction of the fluke against friction is substantially prevented.

According to a first aspect of the present invention there is provided a marine anchor for drag embedment in a submerged soil comprising a fluke and a shank attached to the fluke, means for attaching first and second anchor cables to the anchor so as to lie in first and second directions respectively from the fluke centroid whereby, in relation to the forward direction (F) of the fluke measured in a fore-and-aft plane of symmetry (M—M) of the anchor, the first direction forms a first forward-opening angle ($\alpha$) with the forward direction (F) and the second direction forms a second forward-opening angle ($\beta$) with the forward direction (F) greater than the first forward-opening angle ($\alpha$) so that the projected area of the fluke in the second direction is greater than the projected area of the fluke in the first direction whereby a first pulling action on the anchor via the first anchor cable at an attachment point located in the first direction permits drag embedment of the anchor by movement substantially in the forward direction (F) in the soil whilst a subsequent pulling action on the embedded anchor in the soil via the second anchor cable at an attachment point in the second direction precludes such movement, at least a portion of the shank to which the first anchor cable is attached being releasable from the anchor, and remotely operable release means for release of the shank portion following drag embedment of the anchor.

According to a second aspect of the present invention there is provided a marine anchor for drag embedment in a submerged soil comprising a fluke and a shank attached to the fluke, arranged to provide at least one attachment point for attachment of an anchor cable, at least a portion of the shank being pivotable about a pivot axis located in the anchor transverse to a fore-and-aft plane of symmetry (M—M) of the anchor, so that the anchor cable attachment point is movable between first and second directions from the centroid of the fluke such that in relation to the forward direction (F) of the fluke measured in the plane of symmetry (M—M) the direction forms a first forward-opening angle ($\alpha$) with the forward direction (F) and the second direction forms a second forward opening angle ($\beta$) with the forward direction (F) greater than the first forward opening angle ($\alpha$), so that the projected area of the fluke in the second direction is greater than the projected area of the fluke in the first direction whereby a first pulling action on the anchor via the anchor cable at an attachment point located in the first direction permits drag embedment of the anchor by movement substantially in the forward direction (F) in the soil whilst a subsequent pulling action on the embedded anchor in the soil via the anchor cable at an attachment point located in the second direction precludes such movement, remotely operable means to enable selective movement of the anchor cable from the first direction into the second direction, the pivot axis being located in any one of two locations which are, (1) in the vicinity of a straight line containing the fluke centroid and the anchor cable attachment point lying in the first direction and (b) aft of the straight line.

According to a third aspect of the present invention there is provided a marine anchor for drag embedment in a submerged soil comprising a fluke, a shank having an extremity, the extremity of the shank being attached to the fluke, and means for attaching first and second anchor cables to attachment points on the anchor so as to lie in first and second directions respectively from the fluke centroid, the cable attachment point in the first direction being located close to the forward extremity of the shank means, whereby in relation to the forward direction (F) of the fluke measured in a fore-and-aft plane of symmetry (M—M) of the anchor, the first direction forms a first forward-opening angle ($\alpha$) with the forward direction (F) and the second direction forms a second forward-opening angle ($\beta$) with the forward direction (F) greater than the first forward-opening angle ($\alpha$) so that the projected area of the fluke in the second direction is greater than the projected area of the fluke in the first direction, whereby a first pulling action on the anchor at the attachment point located in the first direction permits drag embedment of the anchor by movement substantially in the forward direction (F) in the soil whilst a subsequent pulling action on the embedded anchor at the attachment point located in the second direction precludes such movement, for both the first and second pulling actions the projection of the shank means orthogonally on to a straight line lying in the forward direction (f) is substantially located aft of a foremost extremity of the fluke.

Preferably, the first and second forward-opening angles are chosen with regard to the angle of friction, $\phi$, between the fluke surface and the marine soil in which the anchor is to be embedded, whereby the first forward-opening angle is less than $90-\phi$ degrees and the second forward-opening angle is in the range of $90\pm\phi$ so that embedment occurs when the anchor is pulled horizontally by the cable and horizontal slippage is prevented when the fluke is finally horizontal and the anchor is pulled vertically by the cable.

It is further preferred that the second forward-opening angle lying in the range $90\pm\phi$ more particularly, lies in the range 84 to 96 degrees for mud operation and 68 to 112 degrees for sand operation.

According to a further aspect of the present invention, a method of controlling the load developed by a marine anchor during drag embedment when pulled in a mooring bed by an anchor cable attached thereto involves:

(a) attaching a control pendant cable to a portion of the anchor shank or to a rearward portion of the anchor cable attached to said shank to enable rotation of the anchor to reduce the angle of inclination of the anchor to the horizontal;

(b) laying out the anchor on the mooring bed and pulling horizontally on the anchor cable to cause embedment of the anchor into the mooring bed;

(c) measuring the load developed in the anchor cable as embedment progresses;

(d) pulling upwards on the control pendant cable when the anchor cable load reaches a designated magnitude and maintaining a fore in the control pendant cable sufficient to rotate the moving anchor and reduce the angle of inclination to the horizontal of the anchor fluke and so reduce the holding capacity of the anchor;

(e) noting the effect of the control pendant force on the measured load in the anchor cable;

(f) varying the force in the control pendant cable in accordance with the noted effect to control the anchor cable load to a constant designated value as the anchor is dragged to a desired installation location.

Preferably said control pendant cable is attached by remotely releaseable attachment means whereby said control pendant cable may be released and recovered following installation of the anchor.

Preferably the marine anchor employed in the above method is constructed according to the present invention.

Embodiments of the present invention will now be described by way of example with reference to the accompanying drawings wherein:

BRIEF DESCRIPTION OF THE DRAWINGS

FIG. 1 is a side view of a marine anchor in accordance with a first embodiment of the present invention;

FIGS. 1A to 3A show similar views to FIGS. 1 to 3 for a modified anchor;

DESCRIPTION OF THE PREFERRED EMBODIMENTS

Figure 1A:
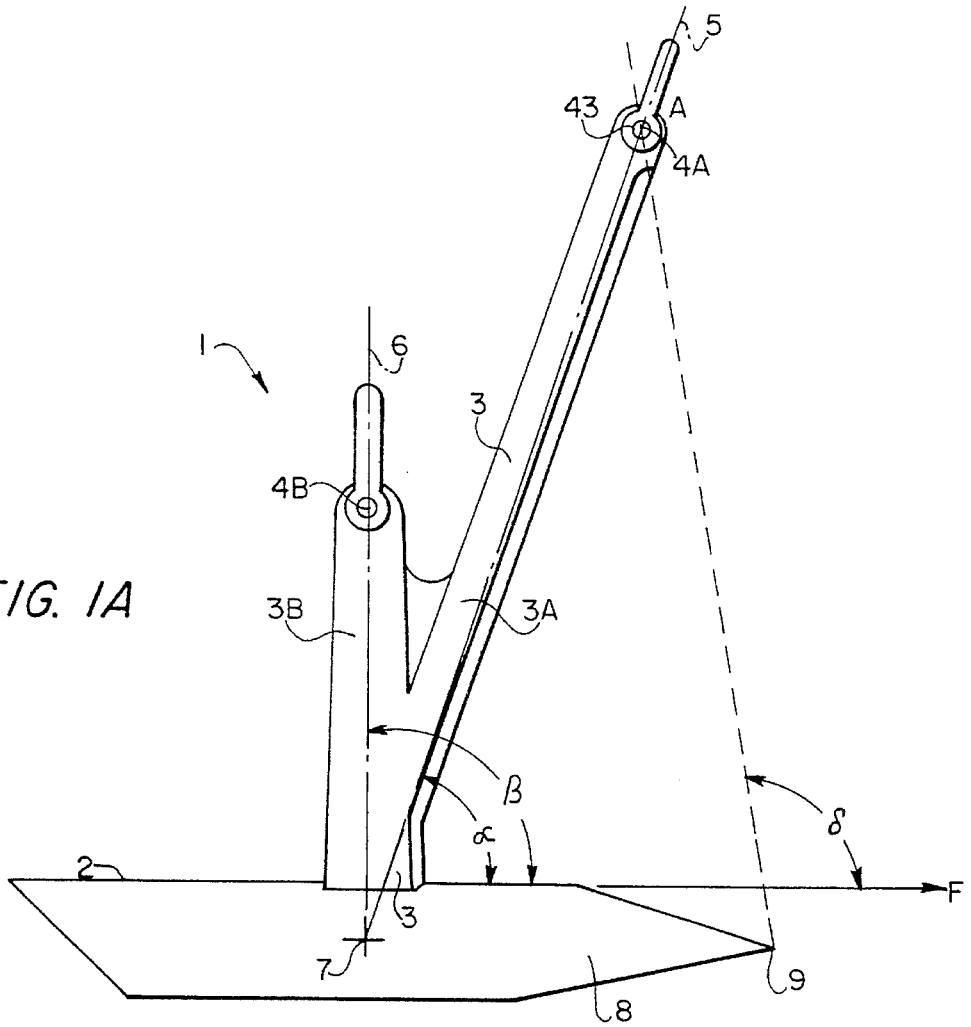

Referring to FIGS. 1 to 5, a marine anchor 1 is symmetrical about a fore-and-aft plane M—M and comprises a fluke 2, a shank 3 attached to the fluke 2 adjacent the centroid 7 of the fluke and including a first anchor cable attachment point 4A comprising a hole at the shank end A furthest from the fluke 2, and a second anchor cable attachment point 4B at the outer end of a slotted hole at an aft position B on the shank between shank end A and fluke 2. Holes 4A, 4B serve to receive the pin of a shackle for attachment of an anchor cable. Fluke 2 comprises two fluke halves, 8, each of generally pentagonal shape in plan view with a foremost point 9 spaced from the plane of symmetry M—M. In front view, the planar upper surface of each half fluke forms an angle $\theta$ in the range 60 to 90 degrees with the plane of symmetry M—M. The ratio of length to width of the fluke in plan view is preferably in the range 1 to 2.

The forward direction F of the fluke 2 is defined by the line intersection of planar surfaces 10 with the plane of symmetry M—M and in the sense of moving from centroid 7 to point 9 in FIG. 1. The centroid fluke angle $\alpha$ (the first centroid fluke angle) is the angle between the forward direction F of fluke 2 and a straight line 5 containing centroid 7 and cable attachment point 4A and is less than (90–$\phi$) degrees, where $\phi$ is the angle of friction between the anchor and the soil in which it is to be embedded. The magnitude of $\phi$ is taken to be 30 degrees for sands and 15 degrees for muds for the purpose of determining $\alpha$. Angle $\alpha$ is shown as about 70 degrees (for mud) in FIG. 1, i.e. less than 75 degrees. The fluke point angle is the angle between the forward direction F of fluke 2 and a straight line containing the first cable attachment point 4A and the projection of fluke points 9 in the plane of symmetry M—M and is in the range 90 degrees to 110 degrees for soft mud and 50 degrees to 70 degrees for sand. Angle $\delta$ is shown as 100 degrees in FIG. 1 for mud.

The straight line 6 containing the fluke centroid 7 and the second cable attachment point 4B forms an angle $\beta$ (the second centroid fluke angle) with the forward direction F of the fluke in the range (90±$\phi$) degrees. Angle $\beta$ is shown as 90 degrees for both mud and sand in FIG. 1. The attachment point 4B is spaced 25 to 100 per cent of the fluke length above the fluke to prevent rotational instability of the fluke 2 about point 4B due to any soil pressure distribution variations over the fluke.

Shank 3 is of plate construction of thickness less than 5 per cent of the fluke width and bevelled on the forward edge to minimise resistance to penetration of the shank into a mooring bed soil. Also, the area of the shank 3 projected in the forward direction F does not substantially exceed seven per cent of the area of the fluke 8 projected at right angles to said forward direction F. In side view, the shank 3 is of Y-shape with a longer upper limb 3A inclined approximately at angle $\alpha$ to direction F and a shorter upper limb 3B inclined at angle $\beta$ to direction F and with a short lower limb 3C of the Y-shape attached to fluke 2 adjacent the fluke centroid 7. In front view, the fluke 2 has maximum depth of section in the plane of symmetry M—M and minimum depth of section distal to M—M, being of generally wedge-shape at each side of M—M and being hollow double-skinned plate construction of minimum frontal cross-sectional area to minimise resistance to penetration in the soil in direction F. Overall, the ratio of plan area of the anchor to area of the anchor projected in direction F is maximised consistent with preserving adequate structural strength so that resistance to motion in direction F is as small as possible whilst resistance to movement at right angles to direction F is as large as possible.

Figure 4:
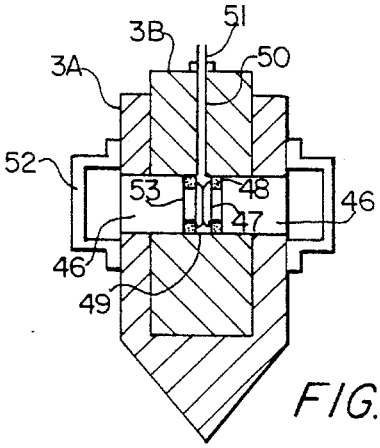
FIG. 4 shows a section P—P through a releasable coupling in the anchor in FIG. 1.
Figure 5:
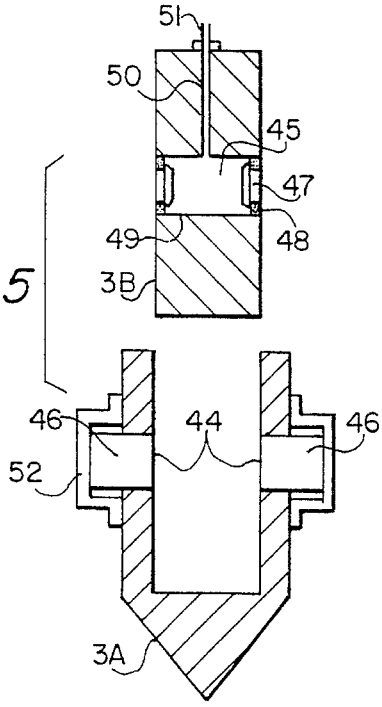
FIG. 5 shows the coupling of FIG. 4 released.

Shank limb 3A is removably mounted on shank limb 3B by means of a pair of lugs 43 attached to the end of limb 3A remote from end A. Lugs 43 are spaced to fit one at each side of limb 3B and have coaxial holes 44 which align axially with a hole 45 in limb 3B to form a clevis and is pinned to limb 3B by means of two cylindrical pins 46 (FIGS. 4 and 5). Pins 46 abut against two pistons 47 fitted with oils seals 48 and lying back-to-back abutting against each other in plane M—M at the centre of hole 45. The pistons 47 have facing bevels 49 which form an annular oil chamber fed by oil through drilled oil-way 50 connected to oil supply pipe 51. Pin travel stops 52 are bolted onto lugs 43 to stop extrusion of pins 4 by oil pressure in hole 45 when the abutting faces 53 between pine 45 and pistons 47 are aligned with the outer surfaces of limb 3B. Faces 53 are adhesively held together by means of a low shear strength adhesive such as epoxy resin which shears when a small load is applied by pulling on the first anchor cable attachment point 4A when faces 53 area in alignment with the outer surfaces of limb 3B.

Shank limb 3B is fitted with a slideable sleeve 54 having a hole 55 to receive a pin 56 of a shackle 57 for attachment of an anchor cable thereto. Hole 55 is positioned to co-operate with slotted hole 4B such that pin 56 passing through hole 55 and slotted hole 4B has a range of sliding movement, carrying sleeve 54 with it, defined by the slotted hole 4B. Coaxial holes 58 are present in sleeve 54 and limb 3B to receive a shearable pin 59 which locks sleeve 54 in the position wherein pin 55 is located at the end of slotted hole 4B nearest fluke 2. A pulling force exceeding the shear failure load of shearable pin 59 in a direction at right angles to direction F will shear pin 59 and move pin 55 (and so sleeve 54) away from fluke 2 by the travel allowed by slotted hole 4B. A lug 60 is attached to the aft face of sleeve 54 and a similar lug 61 is attached to the aft face of limb 3B. An oil-filled hydraulic cylinder 62 is connected to lug 60 with its piston rod connected to lug 61. Cylinder 62 is connected by oil supply pipe 51 to the drilled oil-way 50 in limb 3B whereby movement of pin 55 along slotted hole 4B following shearing of pin 59 actuates cylinder 62 and pumps oil into hole 45 between pistons 47. This extrudes pins 46 from hole 45 and allows limb 3A to be pulled away from limb 3B on sharing of the adhesive between abutting faces 53 to permit recover of limb 3A and the anchor cable attached thereto. An alternative arrangement is envisaged where the pin extrusion mechanism is located at attachment point 4A and in an anchor shackle attached thereto.

In this case, limb 3A would not be recovered with the anchor cable and would be constructed simply as an integral part of shank 3.

Yet another arrangement is envisaged (see FIGS. 1A to 3A) wherein the complete release mechanism for releasing the anchor cable attached to point 4A is deleted and points 4A and 4B have only round holes for receiving shackle pins. In this arrangement, limbs 3A and 3B are integral parts of shank 3 and a shearable shackle pin at point 4A permits recovery of a first anchor cable.

Figure 6:
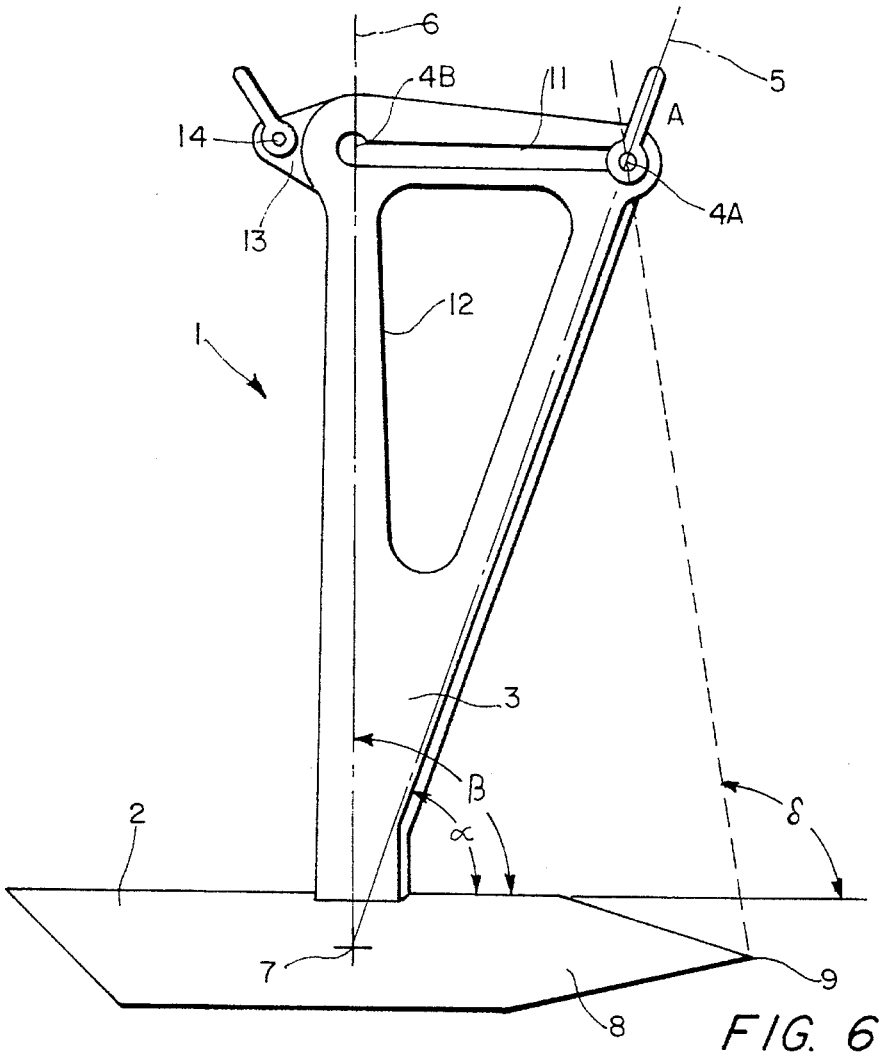
FIGS. 6 to 8 show similar views to FIGS. 1 to 3 for a second embodiment of the present invention.
Figure 7:
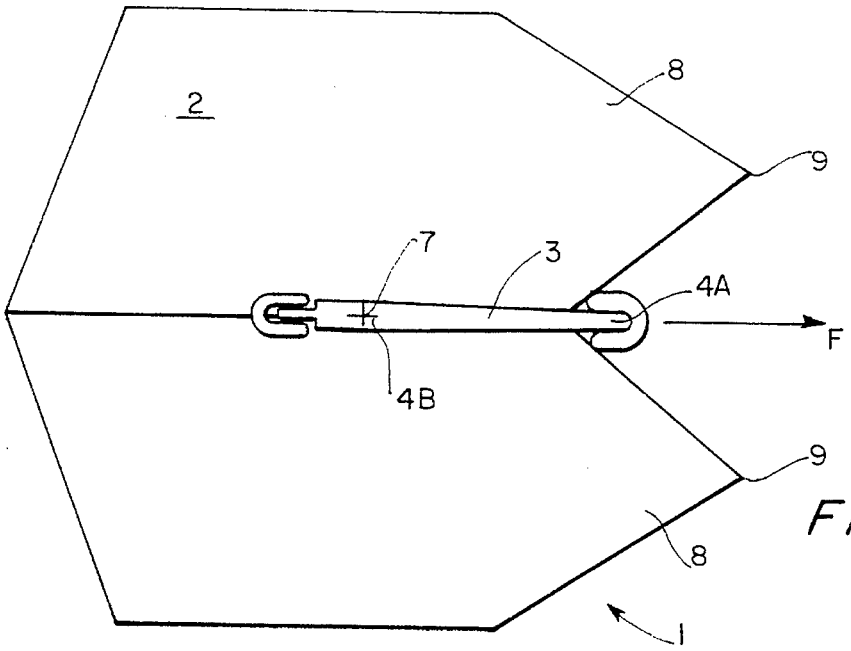
Figure 8:
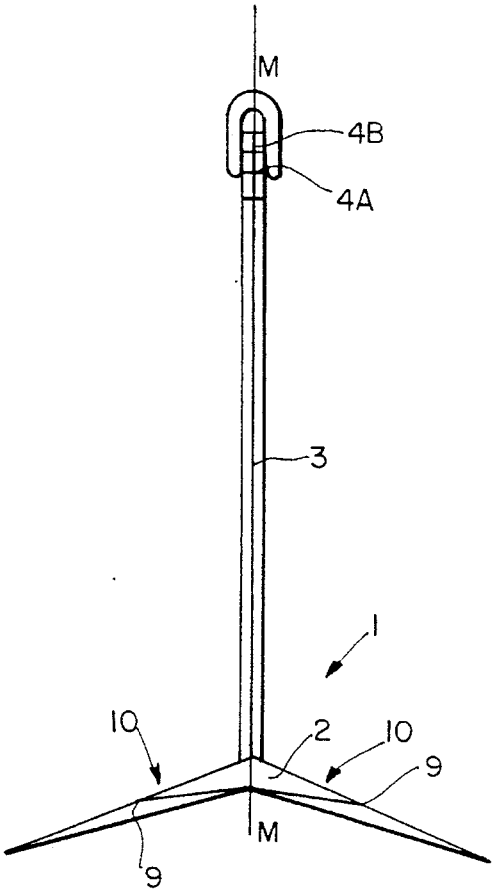

In the embodiment of FIGS. 6 to 8, the second anchor cable attachment point 4B is separated from the fluke by approximately one length of the fluke and connected to the first anchor cable attachment point 4A by a slot 11 in the shank 3 so that sliding movement of a shackle pin therein can transfer an anchor cable attached thereto from point 4A to point 4B. The axis of slot 11 intersects the centre of a shackle pin hole at point 4A but intersects a shackle pin hole at point B offset towards fluke 2 so that the shackle pin can lodge under load in the hole at point 4B. Generally, the anchor corresponds to the anchor shown in FIGS. 1 to 3 and like parts carry like references. Shank 3 is of triangular shape in side view with a triangular aperture 12 therein to reduce weight. A lug 13 having a hole 14 is attached to shank 3 adjacent anchor cable attachment point 4B to receive a shackle pin for attachment of an anchor pendant cable thereby. The anchor of FIGS. 6 to 8 will probably be more suited for lighter load applications e.g. for yachts and small boats.

In the embodiment of FIGS. 9 to 13, the first anchor cable attachment point 4A is physically moveable by virtue of shank 3 being rotatable about pivot 15 in the fluke 2 so that point 4A can move out of line 5 into line 6 to become point 4B corresponding to point 4B in FIG. 4. The anchor corresponds to the anchor shown in FIGS. 1 to 3 and like parts carry like references. Pivot 15 has an axis 16 normal to the plane of symmetry M—M and located in the fluke 2 aft of fluke centroid 7 below planar surfaces 10. A pivot pin 17 serves to locate lug 18, comprising the end of shank 3 remote from end A, between two lugs 19 attached to the underside of the fluke. Shank 3 passes through aperture 20 in fluke 2 with a forward edge 21 of the aperture 20 abutting against the forward edge 22 of shank 3 which edge 21 serves as a stop to stop rotation of the shank 3 form forming a fluke centroid angle α less than that given for the embodiment of FIGS. 1 to 3.

Figure 2A:
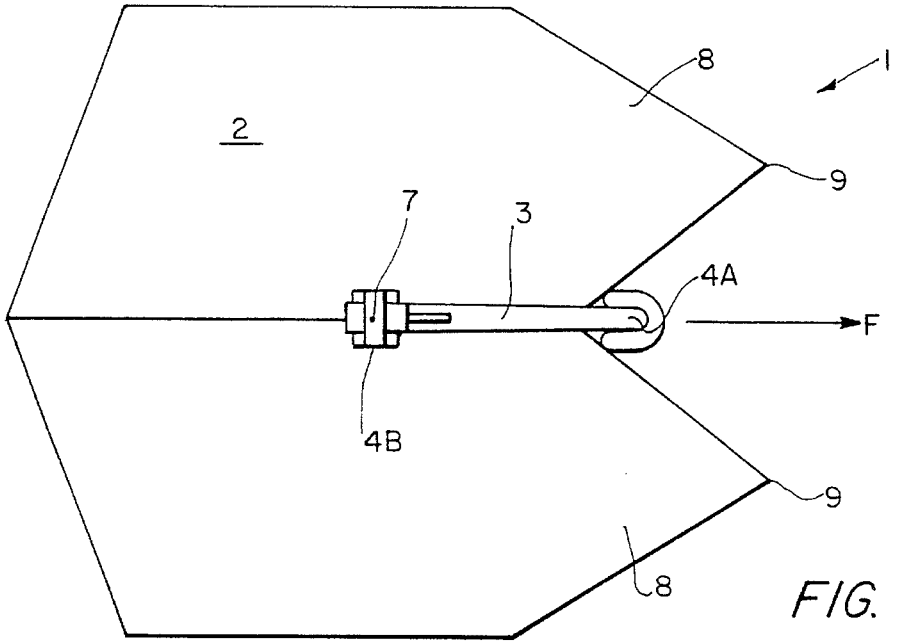
FIG. 2 is a plan view of the anchor in FIG. 1.
Figure 3:
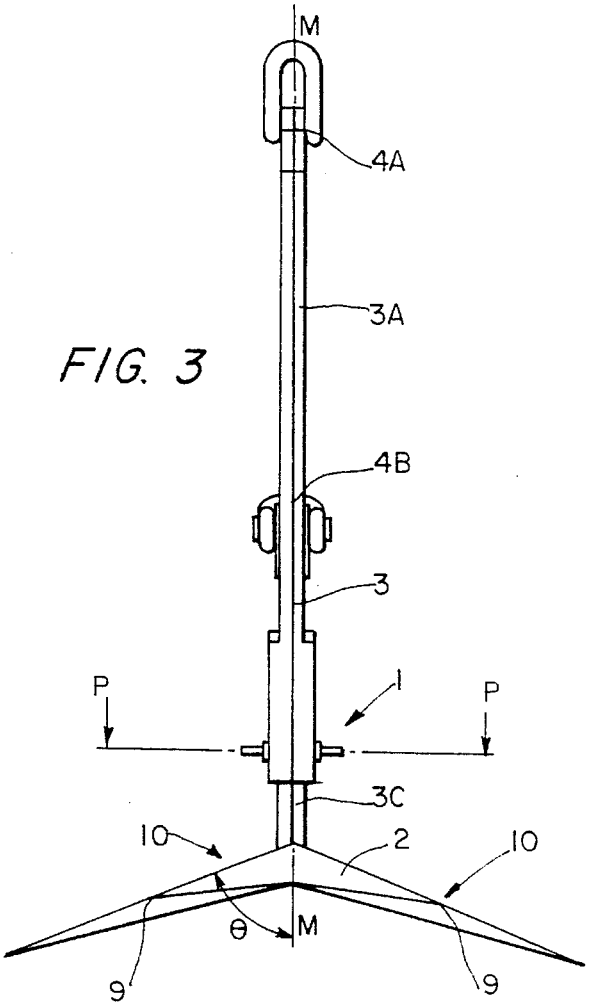
FIG. 3 is a front view of the anchor in FIG. 1.
Figure 3A:
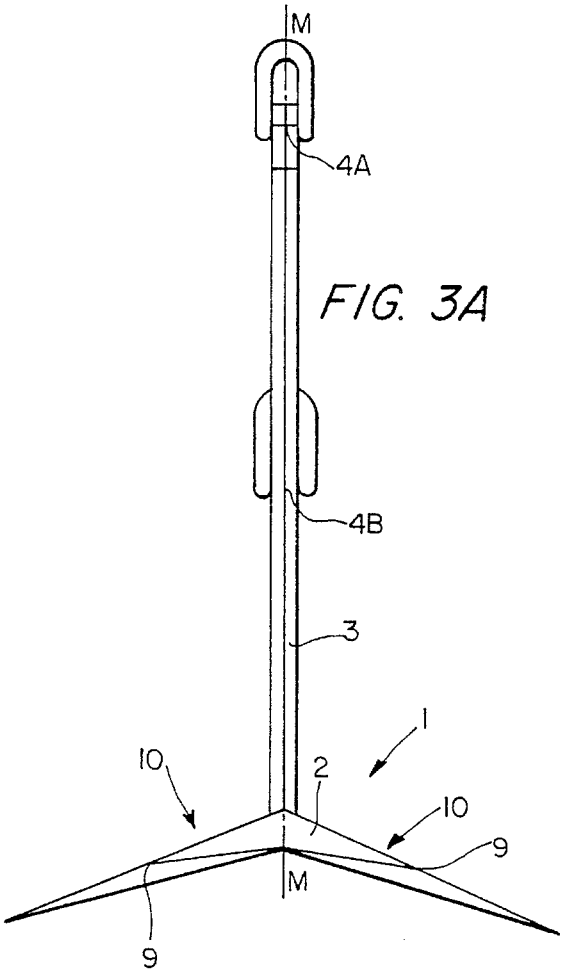
Figure 13:
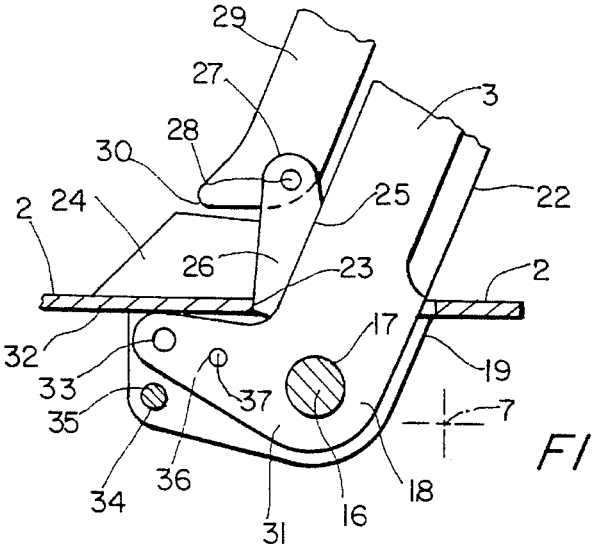
FIG. 13 shows an alternative pivot stop mechanism for the anchor in FIGS. 9 to 11.
Figure 12:
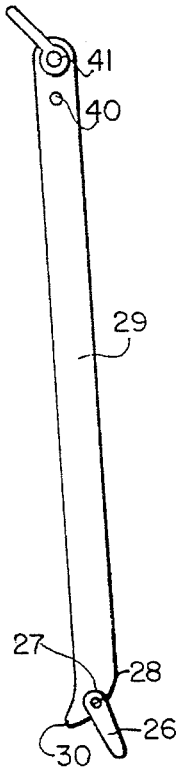
FIG. 12 shows positions of parts of the anchor in FIGS. 9 to 11 following operation of a shank pivot release mechanism.

A rearward edge 23 of aperture 20 and a stop 24 attached to fluke 2 can abut against a rearward edge 25 of shank 3 to stop rotation of shank 3 from forming an angle β great than that given for the embodiment of FIGS. 1 to 3. A wedge-shaped stop 26 bearing a pin clevis 27 and pin 28 is removably interposed between edge 25 of shank 3 and stop 24 to lock shank 3 temporarily with point 4A in line 5. A stop removal lever 29 is pivotably attached at one end by pin 28 to clevis 27 on wedge-stop 26 and laid off lengthwise along rear edge 25 of shank 3. A toe 30 is formed on lever 29 adjacent pin 28 which can bear on stop 24 following rotation of lever 29 away from shank edge 25 and in turn act as a fulcrum for further rotation of lever 29 to prise wedge-stop 26 forcibly out of its position between stop 24 and edge 25 to permit shank 3 to rotate into abutment with stop 24 and so bring point 4A out of line 5 into line 6. A spring loaded wedge stop (not shown) under the fluke is now free to move up between edge 21 and edge 22 to lock shank 3 with point 4A at location 4B in line 6. An alternative stop and locking arrangement for shank 3 is shown in FIG. 13 wherein a crank arm 31 is provided which bears on fluke plate 32 under stop 24 to restrict forward rotation of shank 3 instead of edge 22 bearing on edge 21. A hole 33 is provided at the extremity of arm 31 which aligns with a corresponding hole 34 in lugs 19 when shank 3 rotates to bring edge 25 into abutment with stop 24. A spring loaded bolt 35 is mounted in hole 34 in one of lugs 19 which threads hole 33 when aligned with holes 34 to lock shank 3 to lugs 19 with the anchor cable attachment point 4A in position 4B (FIGS. 12 and 13) and lying in line 6. Another hole 36 in arm 31 is provided which is in initial alignment with corresponding coaxial holes in lugs 19. A shearable pin 37 may be fitted in hole 36 to lock shank 3 to lugs 19 when point 4A is initially in line 5 whereby exceeding a designated moment of force about pivot axis 16 shears pin 37 and so allows shank 3 to rotate rearwards.

Shank 3 has clevis lugs 38 with coaxial holes 39 located on the rear edge 25 spaced approximately 20 per cent of the shank length from point 4A. Lever 29 (FIGS. 12 and 13) has a length of 0.8 times the length of shank 3 and has a lug hole 41 at an end remote from toe 30 to receive a shackle pin for connection thereto of an anchor pendant cable. Lever 29 also has a hole 40 for coaxial registration between lugs 38 with holes 39. A shearable pin 42 is fitted through holes 39 and 40 which is breakable by a designated force applied at hole 41 by pulling up on the anchor pendant cable. Further pulling up on the anchor pendant cable removes the lever 29 and wedge-stop 26 bodily from embedded anchor 1. This allows the fluke centroid angle to increase from α to β under the rotative moment about pivot axis 16 of soil forces distributed over surfaces 10 of fluke 2 acting effectively at fluke centroid 7.

Figure 11:
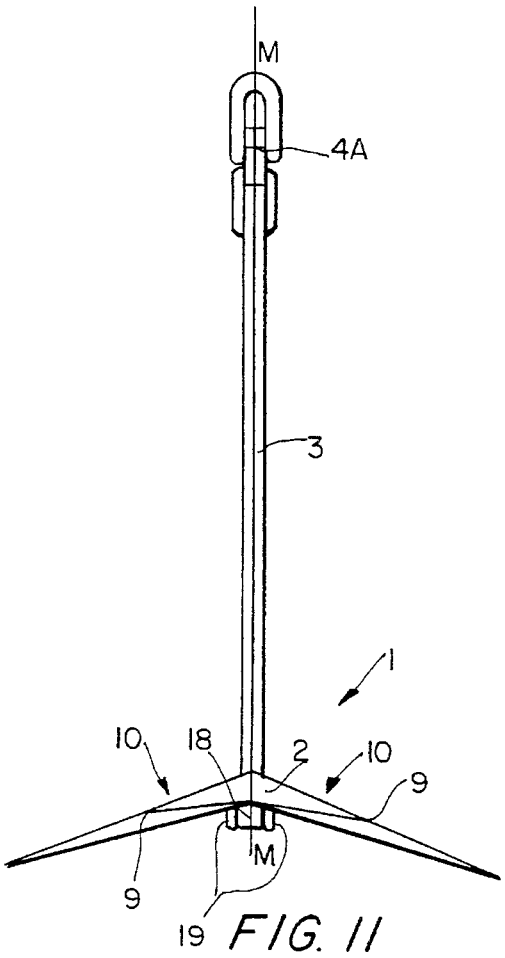
FIGS. 9 to 11 show similar views to FIGS. 1 to 3 for a third embodiment of the present invention including a pivoting anchor shank.
Figure 9:
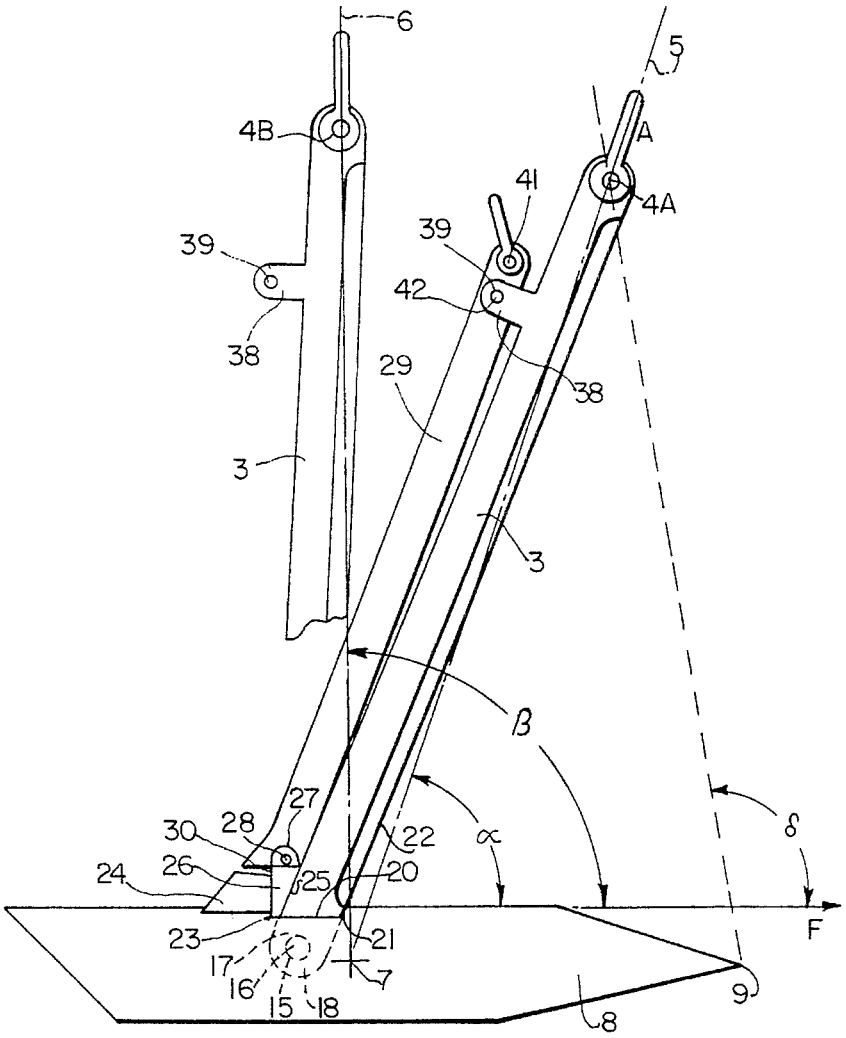
Figure 10:
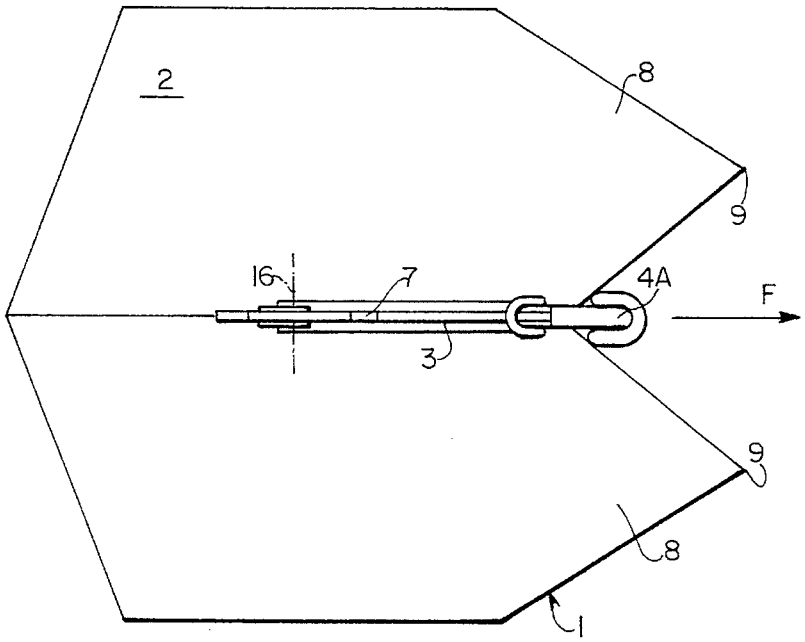

Referring now to FIGS. 14A to 14D which show a method of positioning and an anchor 1 with a designated cable tension using an anchor according to FIGS. 9 to 11 of the present invention as anchor 1 is installed in a submerged mooring bed 63 by means of two cables 64, 65 attached thereto, with cable 64 attached at point 4A and with cable 65 attached at hole 4B by means of shackle 57 in the embodiment of FIGS. 1 to 3 or attached at hole 41 in the lever 29.

Figure 14A:
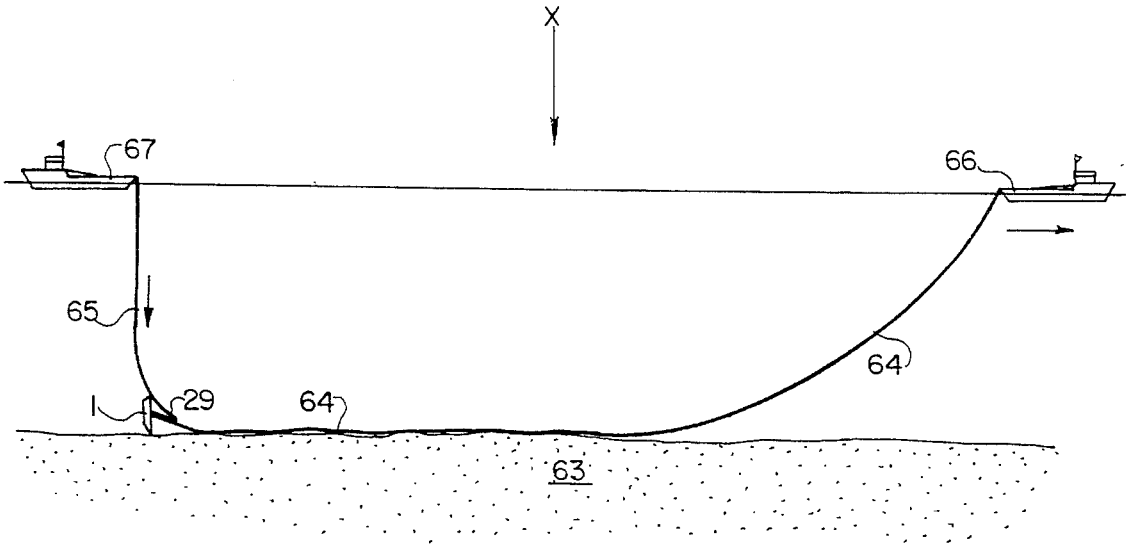
FIGS. 14A to 14D show pictorial view illustrating operation of the invention.
Figure 14B:
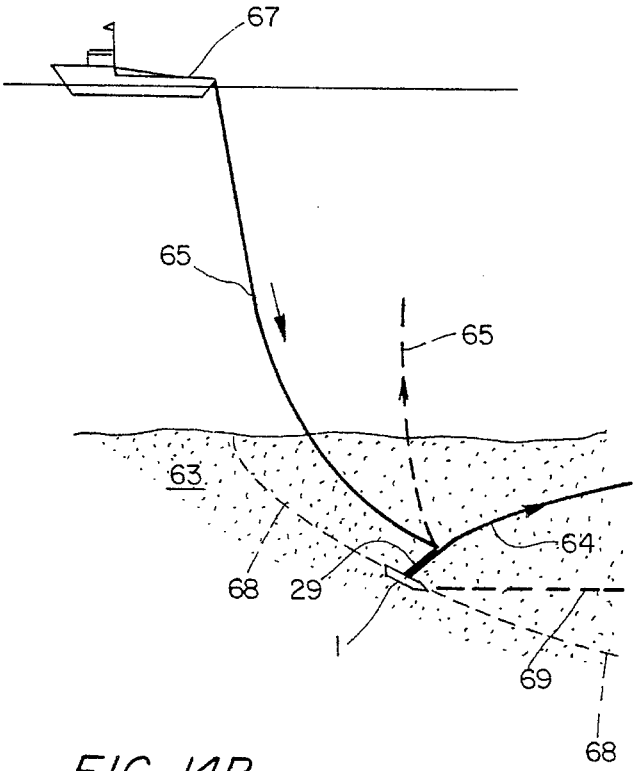

The anchor 1 is deployed from the deck of a first anchor handling vessel (AHV) 66 which pays out cable 64 from its winch drum. Cable 65 is passed to a second AHV 67 which pulls the anchor off the deck of AHV 66 into the water over the mooring bed. Anchor 1 is lowered into contact with the surface of mooring bed 63 as shown in FIG. 14A by controlled paying out of the two cables 64, 65 so that anchor 1 contacts the mooring bed 63 fluke first with direction F aligned with the desired dragging path in the mooring bed. This contact point is chosen sufficiently distant from a desired installation position X that a desired tension in cable 64 is likely to be achieved or exceeded on dragging anchor 1 to position X by cable 64. Further paying out of cable 64 coupled with horizontal movement of AHV 66 rotates anchor 1 to bring shank end A into contact with the mooring bed surface and lays cable 64 out horizontally on the mooring bed 63 in the desired pulling direction. Referring to FIG. 14B AHV 67 now pays out slack in cable 65 while AHV 66 pulls horizontally to cause anchor 1 to embed into the mooring bed and follow a burying trajectory 68 which, in turn, causes the tension in cable 64 to increase an anchor 1 approaches the desired installation position X.

AHV 66 includes means for measuring the tension in the cable 64 and as such means are well known and well established in the anchor art it is not felt necessary to specifically describe suitable means: similar means are employed in AHV 67 to measure the tension in cable 65. Further it will be seen in FIG. 14B that the cable 65 has streamed out backwardly adjacent the anchor due to the reaction with the mooring bed soil so that a pull on the cable 65 at AHV 67 will cause the anchor 1 to rotate towards the horizontal.

Figure 14C:
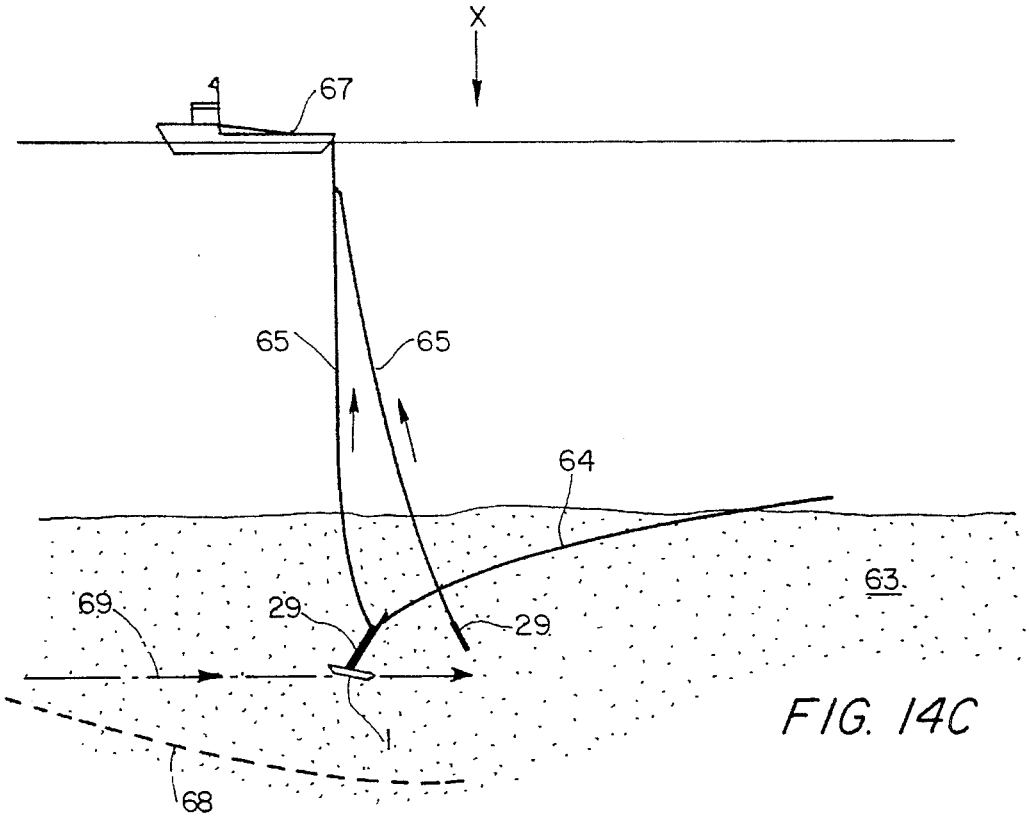

If the build-up of tension in cable 64 measured by AHV 66 indicates that the desired tension will be exceeded before anchor 1 reaches position X, AHV 66 instructs AHV 67 to pull up on cable 65 to rotate anchor 1 in the mooring bed soil to decrease the inclination of fluke 2 to the horizontal and so reduce the digging capability and, hence, the holding capacity of anchor 1 as it is dragged towards the position X. By co-operation between AHV 66 and AHV 67, to maintain the designated upper limit of the tension in the cable 64 by virtue of appropriate pulling action on the cable 65 so adjusting the tension in this cable anchor 1 may be dragged at a controlled constant tension in cable 64 and so follow a horizontal trajectory 69 in the mooring bed until position X is reached as shown in FIG. 14C.

Figure 14D:
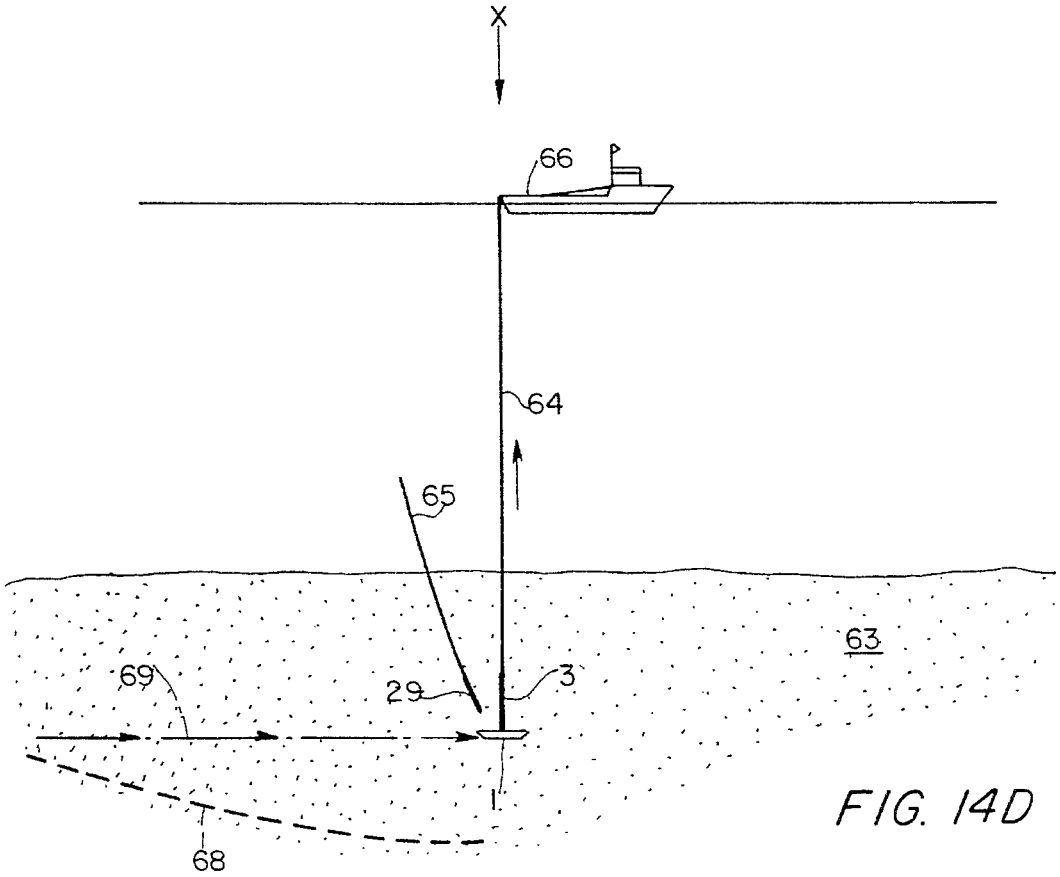

Following embedment of the anchor 1 and position X, AHV 67 pulls forcibly on cable 65 to break shear pin 42, rotate lever 29, prize wedge-stoop 26 clear of stop 24 and shank 3, and remove lever 29 bodily from anchor 1 for recovery on board of cable 25 and lever 29. To achieve high vertical restrain load in cable 64, AHV 66 then moves vertically over anchor 1 (as shown in FIG. 14D) and pulls forcibly on cable 64 to rotate shank 3 into abutment with stop 24 and then rotate anchor 1 to bring fluke forward direction F into the horizontal. Alternatively, to achieve horizontal restraint load in cable 64, AHV 66 simply pulls forcibly on cable 64 following removal of wedge-stop 26 to cause fluke 2 to rotate about axis 16 due to the offset moment of soil forces on flukes 2 acting at centroid 7 until stop 24 abuts against shank 3 where upon fluke forward direction F is at right angles to the direction of cable 64 adjacent shank end A. Instead of the anchor of the FIGS. 9 to 11 embodiment, it would be possible to use the anchor of either the FIGS. 1 to 3 embodiment or the FIGS. 6 to 8 embodiment. For the former, the cable 65 is attached to hole 4B by means of shackle 57 whereas for the FIGS. 6 to 8 embodiment the cable 65 is attached at hole 14.

Where the anchor of the embodiment of FIGS. 1 to 3 is used, following embedment at position X, the AHV 66 then slacks back on cable 64 while AHV 67 pulls up forcibly on cable 65 to break shear-pin 59 and actuate the hydraulic release mechanism hereinbefore described to release shank limb 3A together with attached cable 64 from anchor 1. AHV 66 then hauls in cable 64 to recover it together with shank limb 3A for subsequent re-use and moves off station. AHV 67 then applies more vertical pulling force to point 4B on anchor 1 to rotate fluke 2 until forward direction F is horizontal to obtain a vertical uplift resistance load considerably higher than the horizontal load applied by AHV 66, if high uplift resistance is desired. Alternatively, AHV 67 pays out cable 65 and moves to the position vacated by AHV 66 and applies a high horizontal pulling force to cable 65 to rotate anchor 1 so that fluke forward direction F is at right angles to the axis of cable 65 at point 4B to obtain a horizontal resistance load in cable 65 considerably higher than the horizontal load applied by AHV 66, if high horizontal restraint is desired.

For the embodiment of FIGS. 6 to 8, with a shearable shackle pin fitted in hole 14, following embedment of the anchor 1 at position X, AHV 67 pulls up forcibly on cable 65 to break the shearable shackle pin and release cable 65 for recover onboard. AHV 67 then moves off-station. AHV 66 hauls in cable 64, moves aft of anchor 1 and pulls forcibly upwards and backwards to cause a shackle attaching cable 64 to point 4A to slide along slot 11 to lodge the shackle pin in the offset hole at point 4B. To achieve high vertical restraint load in cable 64. AHV 66 the moves vertically over anchor 1and pulls forcibly on cable 64 to rotate the anchor by load applied at point 4B to bring fluke forward direction F into the horizontal. Alternatively, to achieve high horizontal restraint load in cable 64, AHV 66 pays out cable 64 and moves back over anchor 1 again into the position it occupied when anchor 1 first reached position X. AHV 66 then pulls forcibly horizontally on cable 64 to rotate anchor 1 by application of load at point 4B until fluke forward direction F is at right angles to the direction of cable 64 adjacent point 4B.

It has been found from tests in a tank full of very soft mud using scale model anchors, constructed according to the present invention and deployed as described above, that the peak load obtainable in cable 65 can be as much as five times higher than the peak horizontal force in cable 64 required to embed the anchor until fluke points 9 are approximately five times the length of fluke 2 below the surface of the mud. In sand, similar tests show the peak load in cable 65 can be as much as about two and a half times higher than the peak horizontal force in cable 64 required to embed the anchor until fluke points 9 are approximately about two and a half times the length of fluke 2 below the surface of the sand.

These useful results have not hitherto been obtained from drag embedment anchors.

I claim:

1. A marine anchor for drag embedment in a submerged soil comprising:

a fluke;

a shank attached to said fluke;

means for attaching first and second anchor cables to said anchor so as to lie in first and second directions respectively form the fluke centroid whereby, in relation to the forward direction (F) of said fluke measured in a fore-and-aft plane of symmetry (M—M) of said anchor, said first direction forming a first forward-opening angle (α) with said forward direction (F) and said second direction forming a second forward-opening angle (β) with said forward direction (F) greater than said first forward-opening angle (α) so that the projected area of said fluke in said second direction is greater than the projected area of said fluke in said first direction, whereby a first pulling action on said anchor via said first anchor cable at an attachment point located in said first direction permits drag embedment of said anchor by movement substantially in said forward direction (F) in the soil whilst a subsequent pulling action on said embedded anchor in said soil via said second anchor cable at an attachment point in said second direction precludes such movement, at least a portion of said shank to which said first anchor cable is attached being releaseable from said anchor; and remotely operable release means for release of said shank portion following drag embedment of said anchor.

2. A marine anchor for drag embedment in a submerged soil comprising:

a fluke;

a shank attached to said fluke, said shank providing at least one cable attachment point for attachment of an anchor cable, at least a portion of said shank being pivotable about a pivot axis located in said anchor transverse to a fore-and-aft plane of symmetry (M—M) of said anchor, so that said anchor cable attachment point is movable between first and second directions from the centroid of said fluke such that in relation to the forward direction (F) of said fluke measure din said plane of symmetry (M—M) said first direction forms a first forward-opening angle (α) with said forward direction (F) and said second direction forms a second forward opening angle (β) with said forward direction (F) greater than said first forward opening angle (α) so that the projected area of said fluke in said second direction is greater than the projected area of said fluke in said first direction whereby a first pulling action on said anchor via said anchor cable at an attachment point located in said first direction permits drag embedment of said anchor by movement substantially in said forward direction (F) in the soil whilst a subsequent pulling action on said embedded anchor in said soil via said anchor cable at an attachment point located in said second direction precludes such movement and;

remotely operable means to enable selective movement of said anchor cable from said first direction into said second direction;

said pivot axis being located in any one of two locations which are, (a) in the vicinity of a straight line containing said fluke centroid and said anchor cable attachment point lying in said first direction and (b) aft of said straight line.

3. A marine anchor as claimed in claim 2, wherein said shank pivotable portion is configured at an end remote from said fluke to form an anchor cable attachment point; and wherein said anchor further includes:

first restraint means to restrain said shank such that said anchor cable attachment point lies in said first direction during drag embedment of said anchor; and first restraint release means for releasing said first restraint means to permit pivoting of said shank to occur to allow said anchor cable attachment point to be moved into said second direction by pulling on the anchor cable following completion of embedment of said anchor.

4. A marine anchor as claimed in claim 3, wherein said pivot axis is spaced aft of the straight line containing said anchor cable attachment point and the fluke centroid, whereby the moment of force in said cable about said axis acts to cause pivoting of said shank relative to said fluke following operation of said first restraint release means.

5. A marine anchor as claimed in claim 3, further comprising second restraint means for halting pivoting of said shank when said cable attachment point lies in said second direction.

6. A marine anchor as claimed in claim 5, wherein said second restraint means includes a stop fixed to at least one of said shank and said fluke.

7. A marine anchor as claimed in claim 6, wherein said stop comprises a locking stop which locks said shank relative to said fluke.

8. A marine anchor as claimed in claim 3, wherein said first restraint means comprises a breakable member linking said shank to said fluke, said breakable member being breakable when a designated vertical load applied to said shank is exceeded by pulling upwards following drag embedment of said anchor.

9. A marine anchor as claimed in claim 8, wherein said breakable member comprises a shearable pin linking said shank to said fluke adjacent said pivot.

10. A marine anchor as claimed in claim 9, wherein the pivot axis is located adjacent the centroid of said fluke and said breakable member is located adjacent the pivot axis such that unit force in the anchor cable in said first direction at a small separation from the pivot axis induces a much smaller force in said breakable member during drag embedment of said anchor than unit force in the anchor cable when pulling subsequently in a vertical direction having a much larger separation from the pivot axis so that a vertical force considerably smaller than the drag embedment force can break said breakable member and rotate said shank portion into said second direction.

11. A marine anchor as claimed in claim 3, wherein said first restraint release means is remotely actuable from above the surface of the soil.

12. A marine anchor as claimed in claim 11, wherein said first restraint release means has an attachment point, said marine anchor further comprising a control pendant cable attached to said first restrain release means at said attachment point, said first restraint release means being remotely actuable by said control pendant cable, whereby a vertical pull applied to said control pendant cable actuates said first restraint release means.

13. A marine anchor as claimed in claim 12, wherein said first restraint release means comprises a removeable wedge stop located between said shank and said fluke aft of said shank and attached to said control pendant cable, whereby a vertical pull on said control pendant cable following drag embedment of said anchor removes said wedge stop from said anchor and so releases the restraint.

14. A marine anchor as claimed in claim 13, further comprising an elongate lever member having first and second ends, said first end of said lever member being attached to said control pendant cable, and said second end of said lever member being attached to said wedge stop, said second end provided with a protruding toe serving to bear on any one of said fluke and part associated with said fluke to act as a fulcrum thereon, whereby rotation of said lever member about said fulcrum caused by a vertical pull on said control pendant cable prizes said wedge stop from between said shank and said fluke.

15. A marine anchor as claimed in claim 14, further comprising releaseable attachment means actuable by said control pendant cable, and wherein said lever member is attached at said first end to said anchor by said releasable attachment means.

16. A marine anchor as claimed in claim 15, wherein said releasable attachment means if actuated by application of a pulling force in said control pendant cable in excess of a designated value.

17. A marine anchor as claimed in claim 16, wherein said releasable attachment means includes a breakable member which breaks at said designated value of pulling force in said control pendant cable to release said attachment means.

18. A marine anchor for drag embedment in a submerged soil comprising:

a fluke;

a shank attached to said fluke, said shank providing at least one cable attachment point for attachment of an anchor cable, at least a portion of said shank being pivotable about a pivot axis located in said anchor transverse to a plane of symmetry (M—M) of said anchor so that said anchor cable attachment point is movable between first and second directions from the centroid of said fluke such that in relation to the forward direction (F) of said fluke measured in a fore-and-aft plane of symmetry (M—M) of said anchor, said first direction forms a first forward-opening angle ($\alpha$) with said forward direction (F) and said second direction forms a second forward opening angle ($\beta$) with said forward direction (F) greater than said first opening angle ($\alpha$), so that the projected area of said fluke in said second direction is greater than the projected area of said fluke in said first direction, whereby a first pulling action on said anchor via said anchor cable at an attachment point located in said first direction permits drag embedment of said anchor by movement substantially in said forward direction (F) in the soil whilst a subsequent pulling action on said embedded anchor in said soil via said anchor cable at an attachment point located in said second direction precludes such movement;

remotely operable means for enabling selective movement of said anchor cable from said first direction into said second direction;

first restraint means to restrain said shank such that said anchor cable attachment point lies in said first direction during drag embedment of said anchor; and first restraint release means for releasing said first restraint means to permit pivoting of said shank to occur to allow said anchor cable attachment point to be moved into said second direction by pulling on the anchor cable following completion of embedment of said anchor;

said first restraint means being located at the same side of a straight line containing the fluke centroid and aid anchor cable attachment point lying in said first direction as said pivot axis.

19. A marine anchor for drag embedment in a submerged soil comprising:

a fluke;

a shank having an extremity, said extremity of said shank being attached to said fluke; and means for attaching first and second cables to attachment points on said anchor so as to lie in first and second directions respectively from the fluke centroid, said cable attachment point in the first direction being located close to said forward extremity of said shank means, whereby in relation to the forward direction (F) of said fluke measured in a fore-and-aft plane of symmetry (M—M) of said anchor, said first direction forms a first forward-opening angle ($\alpha$) with said forward direction (F) and said second direction forms a second forward-opening angle (β) with said forward direction (F) greater than said first forward-opening angle (α) so that the projected area of said fluke in said second direction is greater than the projected area of said fluke in said first direction, whereby a first pulling action on said anchor at said attachment point located in said first direction permits drag embedment of said anchor by movement substantially in said forward direction (F) in the soil whilst a subsequent pulling action on said embedded anchor at said attachment point located in said second direction precludes such movement, for both said first and second pulling actions the projection of said shank means orthogonally on to a straight line lying in the forward direction (F) is substantially located aft of a foremost extremity of said fluke.

20. A marine anchor as claimed in claim 19, wherein said shank provides separate and distinct first and second attachment points for an anchor cable, each point being provided with its own separate cable.

21. A marine anchor as claimed in claim 20, further comprising cable attachment transfer means for relocating an anchor cable attachment means from said first cable attachment point to said second cable attachment point following drag embedment of said anchor.

22. A marine anchor as claimed in claim 21, further comprising slotted guide means provided between said two cable attachment points to permit sliding movement of an anchor cable attachment point to said second attachment point.

23. A marine anchor as claimed in claim 22, wherein said shank is of substantially triangular shape in side elevation, attached adjacent one apex to said fluke and provided with an attachment hole adjacent each remaining apex to receive a shackle pin for attachment of an anchor cable thereto, and a slot linking said holes centrally for the hole lying in said first direction and offset towards said fluke for the hole lying in said second direction ,whereby an upwards and rearward pull on said anchor cable following drag embedment of said anchor causes the shackle pin to slide in said slot from said first direction hole to lodge in said second-direction hole.

24. A marine anchor as claimed in claim 1, wherein said shank comprises at least one elongate member upstanding from said fluke, wherein the sum of the mean widths of said shank does not substantially exceed 5 percent of the width of said fluke.

25. A marine anchor as claimed in claim 1 wherein the area of said shank projected in said forward direction (F) does not substantially exceed 7 percent of the area of said fluke projected at right angles to said forward direction (F).

26. A marine anchor as claimed in claim 18, further comprising second restraint means for halting pivoting of said shank when the cable attachment point lies in said second direction.

27. A marine anchor as claimed in claim 18, wherein said first restraint means comprises a breakable member linking said shank to said fluke, said breakable member being breakable when a designated vertical load applied to said shank is exceeded by pulling upwards following drag embedment of said anchor.

28. A marine anchor as claimed in claim 18, wherein said first restraint release means is remotely actuable from above the surface of the soil.

29. A marine anchor as claimed in claim 1, wherein said second forward opening angle (β) lies in the range 90°−ϕ to 90°+ϕ, where ϕ is the angle of friction between the soil and said anchor.

30. A marine anchor as claimed in claim 2, wherein said second forward opening angle (β) lies in the range 90°−ϕ to 90°+ϕ, where ϕ is the angle of friction between the soil and said anchor.

31. A marine anchor as claimed in claim 30, wherein said second forward opening angle (β) lies in the range 68°–112°, especially for sand.

32. A marine anchor as claimed in claim 30, wherein said second forward opening angle (β) lies in the range 84°–96°, especially for mud.

33. A marine anchor as claimed in claim 18, wherein said second forward opening angle (β) lies in the range 90°−ϕ to 90°+ϕ, where ϕ is the angle of friction between the soil and said anchor.

34. A marine anchor as claimed in claim 33, wherein said second forward opening angle (β) lies in the range 68°–112°, especially for sand.

35. A marine anchor as claimed in claim 33, wherein said second forward opening angle (β) lies in the range 84°–96°, especially for mud.

36. A marine anchor as claimed in claim 19, wherein said second forward opening angle (β) lies in the range 90°−ϕ to 90°+ϕ, where ϕ is the angle of friction between the soil and said anchor.

37. A marine anchor as claimed in claim 36, wherein said second forward opening angle (β) lies in the range 68°–112°, especially for sand.

38. A marine anchor as claimed in claim 36, wherein said second forward opening angle (β) lies in the range 84°–96°, especially for mud.

39. A marine anchor as claimed in claim 2, wherein said shank comprises at least one elongate member upstanding from said fluke, wherein the sum of the mean widths of said shank does not substantially exceed 5 percent of the width of said fluke.

40. A marine anchor as claimed in claim 18, wherein said shank comprises at least one elongate member upstanding from said fluke, wherein the sum of the means widths of said shank does not substantially exceed 5 percent of the width of said fluke.

41. A marine anchor as claimed in claim 19, wherein said shank comprises at least one elongate member upstanding from said fluke, wherein the sum of the means widths of said shank does not substantially exceed 5 percent of the width of said fluke.

42. A marine anchor as claimed in claim 2, wherein the area of said shank projected in said forward direction (F) does not substantially exceed 7 percent of the area of said fluke projected at right angles to said forward direction (F).

43. A marine anchor as claimed in claim 18, wherein the area of said shank projected in said forward direction (F) does not substantially exceed 7 percent of the area of said fluke projected at right angles to said forward direction (F).

44. A marine anchor as claimed in claim 19, wherein the area of said shank projected in said forward direction (F) does not substantially exceed 7 percent of the area of said fluke projected at right angles to said forward direction (F).

45. A method of controlling the load developed by a marine anchor having a shank and fluke during drag embedment when pulled in a mooring bed by an anchor cable attached thereto, said method comprising:

(a) attaching a control pendant cable to the anchor to enable rotation of the anchor to reduce the angle of inclination of the fluke to the horizontal;

(b) following said step (a), laying out the anchor on a mooring bed and pulling horizontally on the anchor cable to cause embedment of the anchor into the mooring bed;

(c) following said step (b), measuring the load developed in the anchor cable as embedment progresses;

(d) following said step (c), pulling upwards on the control pendant cable when the anchor cable load reaches a designated magnitude and maintaining a force in the control pendant cable sufficient to rotate the moving anchor and reduce the angle of inclination to the horizontal of the anchor fluke and so reduce the holding capacity of the anchor;

(e) in conjunction with said step (d), noting the effect of the control pendant force on the measured load in the anchor cable; and (f) in conjunction with step (e), varying the force in the control pendant cable in accordance with the noted effect to control the anchor cable load to a constant designated value as the anchor is dragged to a desired installation location.

46. A method as claimed in claim 45, wherein said control pendant cable is attached by remotely releasable attachment means whereby said control pendant cable may be released and recovered following installation of the anchor.

* * * * *